United States Patent [19]

Tamiya et al.

[11] 4,391,212

[45] Jul. 5, 1983

[54] ELECTRONIC CONTROL SEWING MACHINE

[75] Inventors: Yoshimichi Tamiya, Narita-Higashi; Yasukata Eguchi, Kunitachi; Hachiro Makabe, Fussa, all of Japan

[73] Assignee: Janome Sewing Machine Co., Ltd., Tokyo, Japan

[21] Appl. No.: 194,289

[22] Filed: Oct. 6, 1980

[30] Foreign Application Priority Data

Oct. 5, 1979 [JP] Japan ..... 54/128660

[51] Int. Cl.[3] ..... D05B 3/02

[52] U.S. Cl. ..... 112/158 E

[58] Field of Search ..... 112/158 E, 121.11, 121.12; 318/567, 569

[56] References Cited

U.S. PATENT DOCUMENTS

| | | | |
|---|---|---|---|
| 4,142,473 | 3/1979 | Itoh | 112/158 E |
| 4,185,571 | 1/1980 | Minalga | 112/158 E X |
| 4,200,048 | 4/1980 | Makabe et al. | 112/158 E |
| 4,220,101 | 9/1980 | Nanai et al. | 112/158 E |
| 4,227,472 | 10/1980 | Bergvall | 112/158 E |
| 4,242,973 | 1/1981 | Makabe et al. | 112/158 E |

*Primary Examiner*—Peter P. Nerbun

*Attorney, Agent, or Firm*—Michael J. Striker

[57] ABSTRACT

An electronically controlled sewing machine to produce stitches and to change the relative position between the needle and the fabric to be sewn. The sewing machine comprises a first memory (ROM1) storing pattern data including the data for producing straight stitches, pattern selecting means selectively operated to select a set of pattern data of such data stored in the first memory and a second memory (ROM2) storing automatic setting information each specific to the selected pattern and controlling commonly the stitches of the selected pattern. An operator control means adjusts the control of the automatic setting information with respect to the stitches of the selected pattern and a calculating means receives the output of at least one of the second memory (ROM2) and the operator controlled means (VR1, VR2) to calculate the stitch coordinate to each of the stitches of the selected pattern.

3 Claims, 3 Drawing Figures

FIG. 2

| | B | K2 | AF | AB |
|---|---|---|---|---|
| S0 | 0 | 0 | 11110 | 01111 |
| S1 | 1 | 15 | 01100 | 10110 |
| S2 | 2 | 15 | 11110 | 10110 |
| S3 | 3 | 15 | 10010 | 10110 |
| S4 | 4 | 15 | 01100 | 01111 |
| S5 | 5 | 15 | 01100 | 11110 |
| S6 | 6 | 15 | 11110 | 11110 |
| S7 | 7 | 15 | 11110 | 11110 |

ELECTRONIC CONTROL SEWING MACHINE

BRIEF DESCRIPTION OF THE INVENTION

The invention relates to a sewing machine, and more particularly relates to a needle position control system of an electronic sewing machine, in which a needle position may be displaced, depending on the stitching type, to the most suitable position in the lateral swinging range of the needle relative to the fabric to be sewn, instead of locating the fabric in reference to the needle.

In sewing up with the straight stitches the edge of fabric which is folded up two or three times, it is conventionally general to displace the needle position to the center of the lateral swinging range of the needle and locate the edge of the fabric under the needle. As a result, the thicker edge of the fabric is placed only on a part of the feed dog and placed under only a part of the presser foot, and the fabric is not suitably transported and also the presser foot is unstable, and therefore a desired stitching operation cannot be attained. Further in case the edge of the fabric is accompanied by the fabric folding operation during stitching, the fabric cannot be suitably displaced relative to the needle and the feed dog. Further in case there are obstacles or steps in the fabric in the sewing direction and additionally the fabric cannot be displaced relative to the needle and the feed dog, a desired stitching operation cannot be attained.

The invention has been provided to eliminate the defects and disadvantages of the prior art. It is a primary object of the invention to provide a sewing machine which is able to displace the needle position in the straight stitching relative to the fabric to be sewn, thereby to elevate the operation efficiency of the sewing machine especially with respect to the edge stitching of the fabric.

It is another object of the invention to provide a sewing machine which is simple in structure and easy in operation for attaining the above mentioned object.

The features and advantages of the invention will be apparent from the following description of the preferred embodiment in reference to the attached drawings.

SUMMARY OF THE INVENTION

The present invention provides a sewing machine to produce stitches, which is electronically controlled to change the relative position between needle and fabric to be sewn. The sewing machine comprises a first memory (ROM1) storing pattern data including the data for producing straight stitches, a pattern selecting means selectively operated to select a set of pattern data of such data stored in the first memory, a second memory (ROM2) storing automatic setting information each specific to the selected patterns and controlling commonly the stitches of the selected pattern, operator controlled means (VR1,VR2) for adjusting the control of the automatic setting information with respect to the stitches of the selected pattern, and calculating means (AU1,AU2) receiving the output of at least one of the second memory (ROM2) and the operator controlled means (VR1,VR2) to calculate the stitches of the selected pattern.

The pattern selective means can comprise pattern selecting switches. One of the pattern selecting switches can be a straight stitch selecting switch. The pattern selecting means can comprise NAND circuits ($NA_1$ to $NA_3$) connected to the pattern selecting switches and a latch can be connected to the NAND circuits and to the second memory.

The pattern selecting means can further comprise a NAND-circuit for detecting pattern selection and connected to the pattern selecting switch and a monostable multivibrator (MM1) connected to and triggered by the NAND circuit for detecting pattern selection and connected to the latch.

The sewing machine can further comprise an automatic-manual switch for needle swing amplitude ratio reduction and a flip-flop circuit (FF1) connected to the monostable multivibrator (MM1), to the calculating means and to the automatic-manual switch (S8). There can also be provided an automatic-manual switch concerning fabric feed control and a second flip-flop circuit (FF2) connected to monostable multivibrator (MM1), to calculating means and to the automatic-manual switch concerning fabric feed control. There can also be provided an AND-OR circuit connected to the monostable multivibrator (MM1) and a time delay circuit (TD) connected to the monostable multivibrator (MM1) and to the first memory.

The sewing machine can further comprise NAND-gate ($NA_5$) connected to time delay circuit and a second latch connected to the NAND-gate ($NA_5$) and to the first memory. A NAND-gate ($NA_6$) can be connected to the time delay circuit and a NAND-gate ($NA_7$) can be connected to NAND-gate $NA_6$ and to the second latch. The sewing machine can also comprise a pulse generator (TPG) and a second monostable multivibrator (MM2) connected to the pulse generator and connected to the NAND-gate ($NA_7$). The first memory preferably produces fabric feed control signals.

BRIEF DESCRIPTION OF THE DRAWINGS

FIG. 2 shows a code table.

DETAILED DESCRIPTION OF THE INVENTION

Figure 1A:
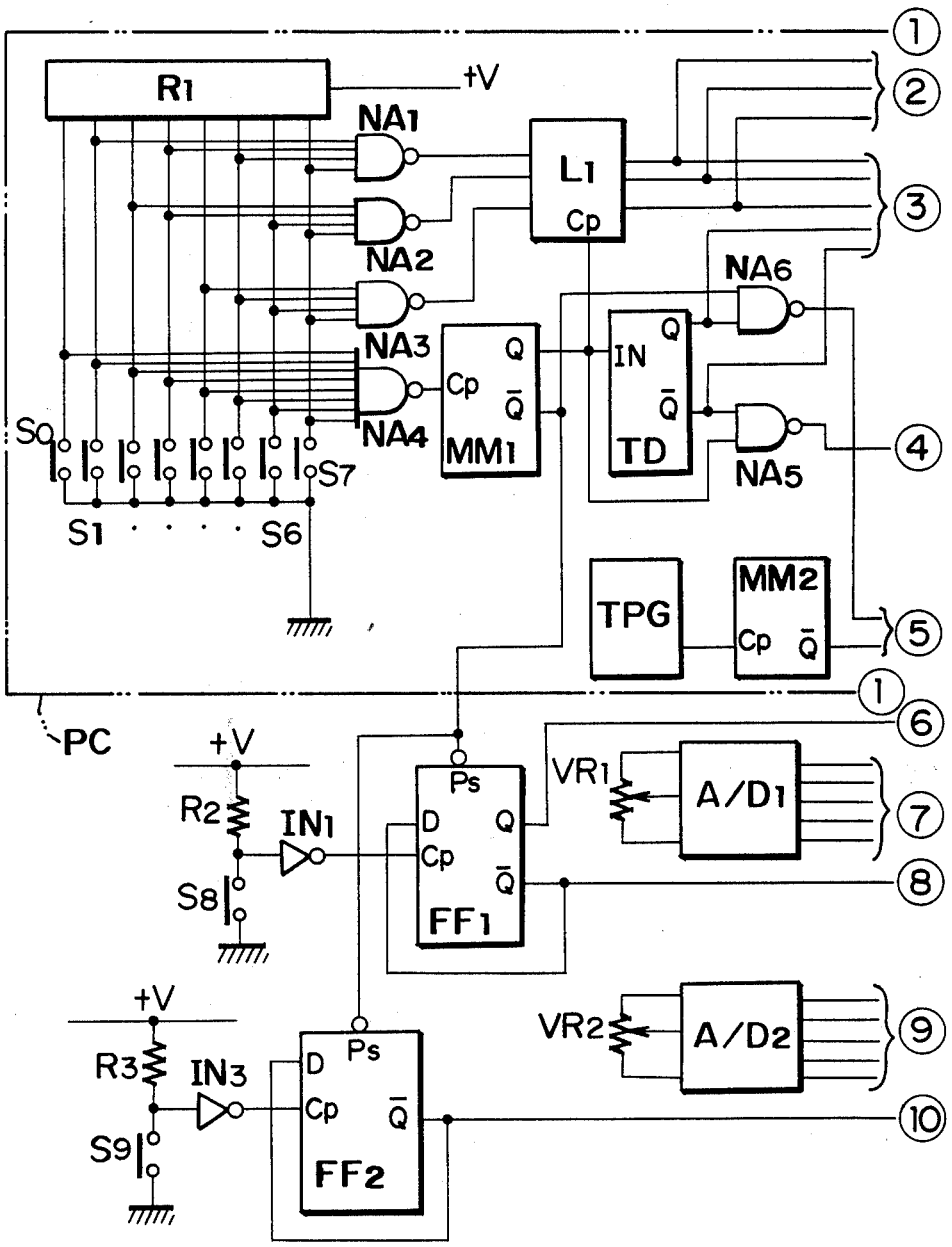
FIGS. 1A and 1B shows a control circuit of an electronic control sewing machine according to the invention.
Figure 1B:
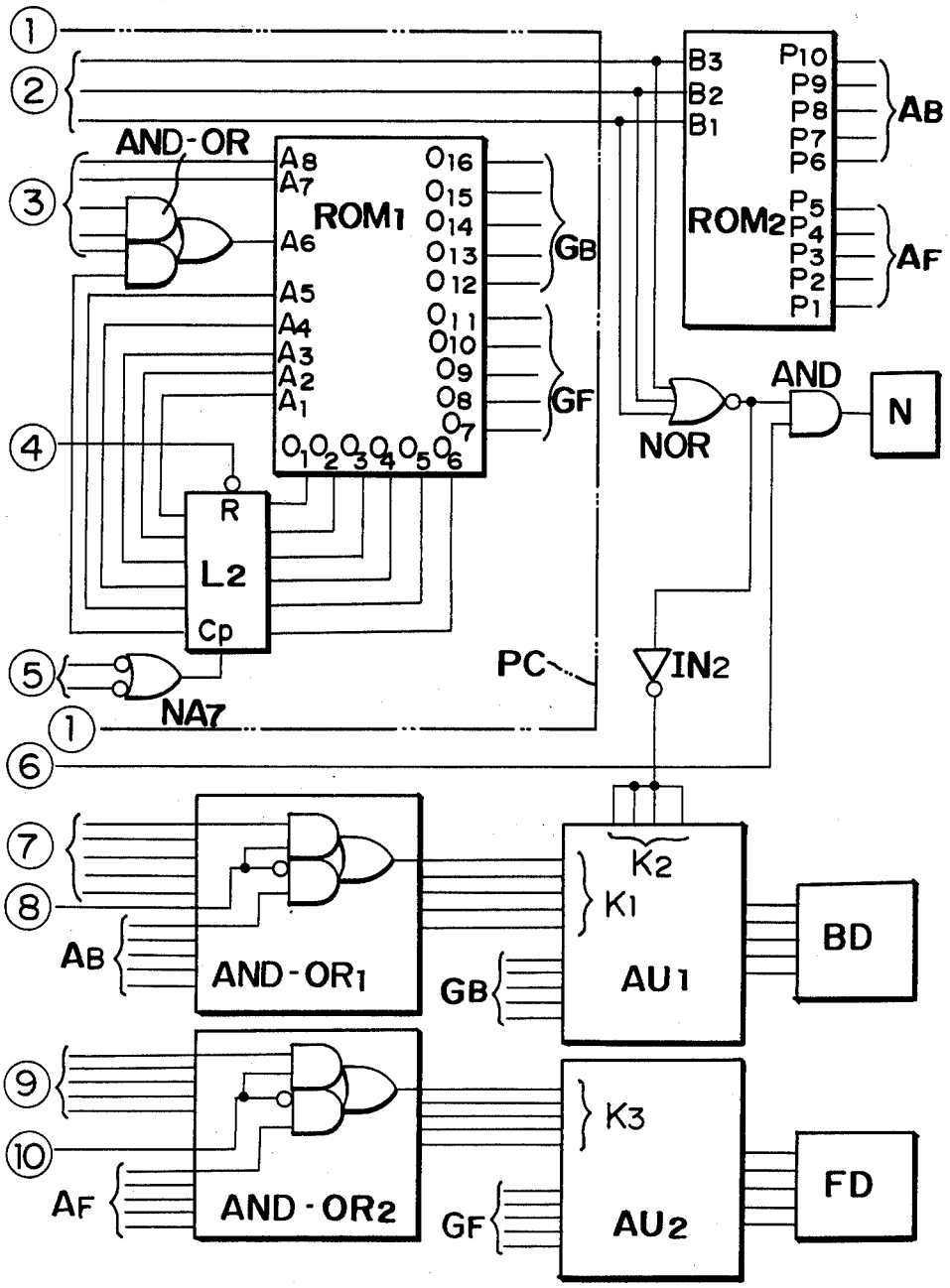

The invention will be explained in reference to the attached drawings. In reference to FIGS. 1A and 1B, PC is a circuit for selecting the patterns to be stitched and generating the signals controlling the stitches of selected patterns, and is substantially the same with that of the Japanese Patent Application No. 50-124,306 of the same applicant. S0 to S7 are pattern selecting switches generally arranged on the front part of the sewing machine. S0 is a straight stitch selecting switch. ROM1 is an electronic memory storing the stitch control data of the patterns to be stitched, and has the input terminals A1–A8 for receiving the address signals which are produced at the address changing output terminals 01–06 for addressing said memory itself per each of the stitches. The memory has the output terminals 07–011 of fabric feed control signals which are called as (GF) hereinafter. Those feed control signals (GF), when they include no reducing ratio of the needle swinging movement, designate the fabric feeding amount of 2.5 mm in the reverse direction by the digital number 0 and the fabric feeding amount of 2.5 mm in the normal forward direction by the digital number 30, thus dividing the fabric feeding range into 30 positions. The memory also has the output terminals (012–016) of needle swing control signals which are called as (GB) hereinafter to designate the needle position at a point in the maximum leftward direction by the decimal number 0 and at a point in the maximum rightward direction by the decimal number 30, thus dividing the needle swinging range into 30 positions. The straight stitch selecting switch S0 is provided with the data 30 in relation to the basic needle position changing data in a manner which will be described hereinafter.

L1 and L2 are latch circuits. The latch circuit L1 receives the pattern selecting signals of the switches S0–S7 via NAND circuits NA1, NA2, NA3 encoding the pattern selecting signals. If one of the switches is operated, the monostable multivibrator MM1 receives at the trigger terminal Cp a rising signal of NAND circuit NAND4 detecting the pattern selection. Thus the monostable multivibrator MM1 is operated. Then the latch circuit L1 receives at the trigger terminal Cp the signal of the monostable multivibrator MM1 and latches the encoding pattern selecting signals so that the memory ROM1 may perform the addressing operation based on the selected pattern. AND-OR circuit AND-OR, which is operatively connected to the monostable multivibrator MM1 and the time delay circuit TD, gives at the time of pattern selection 1 bit as an addressing signal to the input terminal A6 of the memory ROM1. The 1 bit is so selected that the AND-OR circuit produces another 1 bit of the outputs of the latch circuit L2 as the subsequent address signals.

The latch circuit L2 is at first reset by the pattern selecting signal passing through NAND circuit NA5, and is released from the reset condition by activation of the monostable multivibrator MM1. The latch circuit L2 receives at the trigger terminal Cp a signal passing through NAND circuits NA6, NA7 and rising at the delaying circuit TD, and latches the signals of the address changing terminals O1–O6 directed to the address input terminals A1–A6 of A1–A8 of the memory ROM1 for making the first stitch. Then each time when the latch circuit L2 receives at its trigger terminal Cp the rising signal, through the monostable multivibrator MM2, of the pulse generator TPG operated in synchronism with rotation of the upper shaft of the sewing machine, the latch circuit L2 latches the signals of the address changing terminals O1–O6 to the address input terminals A1–A6 for the subsequent stitches.

R1 is an ordinary limit resistor connected to a DC control power source (+V) and giving a reference control voltage to each of the switches S0–S7.

The output from the pulse generator or position detector TPG is at H level (H) in a region where the needle is located above the fabric, while it is at L level (L) in a region where the needle penetrates into the fabric, and the output terminal thereof is connected to the trigger terminal Cp of the monostable multivibrator MM2. ROM2 is an electronic auxiliary memory storing automatic setting data specific to individual stitch patterns stored in the ROM1. The ROM2 receives, as the address signals, at the input terminals B1, B2, B3 thereof, the pattern selecting signals from the latch circuit L1, and releases from the stored contents in response to said address signals, two groups of 5 bits setting data. The stored contents are as shown in FIG. 2 in which (B) shows, in the decimal system, the address codes which are designated by the address terminals B1, B2, B3 in response to the pattern selection. The numerals 0 to 7 correspond to the pattern selecting switches S0–S7. (AF) are the data to be used for calculation to automatically set the fabric feeding conditions in relation with the selected patterns, and the setting data are issued from the output terminals P1–P5. Similarly, (AB) are data to be used for calculation for automatically setting the needle lateral swinging amplitude, and are issued from the output terminals P6–P10. (N) is a needle dropping hole changing device which enlarges the needle dropping hole in a laterally elongated hole when the patterns of stitches made by the needle lateral swinging movements are selected by the pattern selecting switches S1–S7, and which reduces the laterally elongated hole into a circle hole when the straight stitching is selected by the switch S0. In addition to the straight stitching selection, if some operation, which will be described hereinafter, is made to change the needle position for the straight stitches, the device N is operated to change the needle dropping hole into the laterally elongated one. Such a needle dropping hole changing control device which is provided with an electromagnetic drive control element, is disclosed in the Japanese Patent Application No. 53-7680 of the same applicant. When the straight stitching is selected by the pattern selecting switch S0, NOR circuit NOR receives the code 0 0 0 issued from the latch circuit L1 and produces the signals of H level which is applied to one input of AND circuit AND. This input causes the AND circuit to provide a high level signal at the input of the needle dropping hole changing device N in the condition that the operation is not carried out to change the needle position for straight stitches. Thus, the needle dropping hole changing device N is caused to provide the reduced circular needle dropping hole. Otherwise the needle dropping hole changing device N is operated by the L level signal to provide the laterally elongated needle dropping hole. S8 is an automatic-manual operating switch for controlling the lateral swinging movement of the needle. If the switch S8 is operated after one of the switches S0–S7 has been operated, the switch S8 changes the automatic set of needle swing amplitude ratio reduction in accordance with the selected pattern to the manual set of such a ratio reduction including the change of the needle position for the straight stitching. The automatic set is recovered by another operation of the switch S8. FF1 is a D-type flip-flop circuit which is set when it receives at the preset terminal PS a falling signal of a complement output terminal ($\overline{Q}$) of the monostable multivibrator MM1. The flip-flop circuit FF1 has a true side output terminal (Q) connected to the other input of AND circuit AND, and makes effective the input of AND circuit AND after selection has been made by the switches S0–S7. The flip-flop circuit FF1 has a data input terminal D connected to the complement output ($\overline{Q}$) thereof so that the flip-flop FF1 may invert the previous condition of the outputs Q, $\overline{Q}$ when FF1 receives the pulse signal at the trigger terminal Cp thereof by operation of the switch S8. When the output (Q) is at L level, FF1 makes L level the input of the needle dropping hole changing control device (N) to designate the needle dropping hole to be laterally elongated. (R2) is a pull-up resistor. (IN1) is an inverter. (VR1) is a variable resistor for manually controlling the reducing ratio of the needle lateral amplitude including the change of needle position for the straight stitching and an operating part of the variable resistor VR1 is disposed at, e.g., the front part of the sewing machine, and the controlled result is converted into a digital value by an analog-digital converter (A/D1) which has a number of data bits each connected to the input of a group of AND-OR circuits (AND-OR) (in the drawing one of them is shown and the others are omitted). Each of AND-OR circuits receives the complement output signal ($\overline{Q}$) of the flip-flop FF1 directly and also in the inverted condition as shown. If the signal is H level, the AND circuit directly receiving the signal receives the data of the converter (A/D1). On the other hand, the AND circuit receiving the inverted signal receives one bit composing the output (AB) of the ROM2. If the inverted signal ($\overline{Q}$) of the flip-flop FF1 is L level, the AND circuit receives the signal of ROM2. The output of the AND-OR circuit (AND-OR1) is connected to the input K1 of the first arithmetic unit AU1, which also has the input receiving the needle swing control data (GB) of ROM1, and has also another input K2 of 4 bits receiving the output of the NOR circuit NOR through the inverter IN2, the output being common to the 4 bits forming the needle position changing code. The arithmetic unit AU1 carries out a calculation according to a formula of $K'1(G'B-K'2)/30+K'2$ wherein the primed value is converted in the decimal number, and gives the encoded data to a needle swing control device (BD). (S9) is an automatic-manual switch concerning the fabric feed control. When the switch (S9) is operated after selection of the switches S0–S7 has been made, it changes the automatic set of fabric feed ratio reduction in accordance with the selected pattern to the manual set of such a ratio reduction. The automatic set is recovered by another operation of the switch (S9). (FF2) is a D-type flip-flop circuit which has the same function with the flip-flop circuit (FF1) but does not have a true side output terminal. (R3) is a pull-up resistor, and (IN3) is an inverter. (VR2) is a variable resistor for manual control of the fabric feed ratio reduction. (A/D2) is an analog-digital converter thereof. (AND-/OR2) is a group of AND-OR circuits, the output of which is connected to the input data terminals (K3) of the second arithmetic unit (U2). The arithmetic unit (AU2) carries out the calculation by the formula of $K'3(G'F-15)/30+15$ similarly as in the arithmetic unit (AU1), and encodes the calculated result to give it to the fabric feed driving device (FD).

In the above mentioned structure, if the straight stitching is selected by the pattern selecting switch (S0), the data G'B of the needle lateral swinging amplitude control signal GB becomes 30. The code of the latch circuit (L1) becomes 0 0 0 to put the output of NOR circuit (NOR) at H level, and therefore the needle position changing code K2 of the first arithmetic unit (AU1) becomes 0 0 0 0 as shown in FIG. 2, and K'2 becomes 0. The flip-flop circuit (FF1) is set via NAND circuit (NA4) and the monostable multivibrator (MM1), and the complement output ($\overline{Q}$) is made at L level and causes the group (AND-OR1) of AND-OR circuits to make the input AB operative, and K1 becomes 0 1 1 1 1 and K'1 becomes 15. The arithmetic unit (AU1) becomes $15(30-0)/30+0=15$ by the formula of $K'1(G'B-K'2)/30+K'2$, and designates the center part of the needle swinging range, and the needle swing driving device (BD) positions the needle at the center position. Concurrently, the AND circuit (AND) becomes H level and the needle dropping hole changing device (N) is operated to provide a reduced circular needle dropping hole. The change of the needle dropping hole is made when the displacement of the needle has been separately detected.

Then if the automatic-manual changing switch (S8) for the needle lateral swinging control is once pushed, the flip-flop FF1 is reset, and the needle dropping hole changing device (N) provides the laterally elongated needle dropping hole. The group of AND-OR circuits (AND-OR1) makes operative the digitalized value of the manually controlled value by operation of the variable resistor (VR1) to provide the input K1 of the arithmetic unit (AU1). When the resistance of variable resistor (VR1) is set at the minimum value, the decimal number K'1 is 0 and "$0(30-0)/30+0=0$" is provided by the formula of $K'1(G'B-K'2)/30+K'2$, and the needle position is designated at a point maximum in the leftward direction. Similarly, when the resistance is set at the maximum value, the decimal number K'1 is 30, and "$30(30-0)/30+0+30$" is provided, and the needle position is designated at a point maximum in the rightward direction. Thus the needle is displaced laterally at a desired position in the swinging range.

When the pattern including the needle swinging movement is selected by operation of any one of the pattern selecting switches (S1–S7), the latch circuit (L1) includes H level in its output code, and therefore, the output of AND circuit (AND) becomes L level, irrespective of the condition of the flip-flop FF1. As a result the needle dropping hole changing device (N) provides a laterally elongated needle dropping hole. The switch (S1) is for selecting the zigzag stitching, and, for example, if it is operated, the data AB of the memory (ROM2) is 1 0 1 1 0 according to the Table in FIG. 2, and the decimal number K'1 becomes 22. The memory (ROM2) gives, at its output GB, 0 0 0 0 0 and 1 1 1 1 0 alternately for the zigzag stitches. Namely, the memory produces 0 and 30 alternately as the decimal number G'B, and the needle position changing code K2 becomes 1 1 1 1 in reference to the Table in FIG. 2, and the decimal number K'2 becomes 15. The arithmetic unit (AU1), therefore, issues $22(0-15)/30+15=4$ and $22(30-15)/30+15=26$, alternately in accordance with the predetermined formule. Thus, the needle swing control device (BD) produces the zigzag stitches which are each reduced at the right and the left ends more than the maximum zigzag stitches in the needle swinging range. The operation including the calculation of the fabric feed is substantially the same as the above mentioned operation.

What is claimed as new and desired to be protected by Letters Patent is set forth in the appended claims:

1. A sewing machine having electronically controlled means to change the lateral position of the needle relative to the fabric to be sewn, comprising a first memory (ROM1) for storing control data for producing different patterns of stitches including data for producing straight stitches, said first memory having input terminals for receiving address signals and output terminals for releasing control signals for lateral swing of the needle and fabric feed control signals;

stitch pattern selecting means coupled to the input terminals of said first memory to release at the output terminals of the same a set of selected control signals;

a second memory (ROM2) for storing automatic setting data specific to individual stitch patterns stored in the first memory, said second memory having input terminals connected to said pattern selecting means and output terminals for releasing automatic setting data for the lateral swing of the needle and fabric feed automatic setting data;

operator controlled setting means (VR1, VR2) for releasing optional needle swing setting data and fabric feed setting data for the selected stitch patterns independently from the automatic setting data in the second memory; and calculating means (AU1, AU2) having input terminals for receiving the control signals from the first memory (ROM1), the automatic setting data from the second memory (ROM2) or the setting data from the setting means (VR1, VR2) to calculate the stich coordinates for each of the stitches of the selected pattern, and output terminals connected to said electronically controlled means.

2. The sewing machine according to claim 1 wherein the pattern selective means comprises pattern selecting switches.

3. The sewing machine according to claim 2 wherein one of the pattern selecting switches is a straight stitch selecting switch.

* * * * *